United States Patent [19]

Davis

[11] 4,333,549

[45] Jun. 8, 1982

[54] CAR BLOCKING APPARATUS

[75] Inventor: Meredith R. Davis, Bristol, Conn.

[73] Assignee: Otis Elevator Company, Farmington, Conn.

[21] Appl. No.: 162,870

[22] Filed: Jun. 25, 1980

[51] Int. Cl.[3] ..... B66B 5/16

[52] U.S. Cl. ..... 187/93; 187/88; 188/189; 24/136 A

[58] Field of Search ..... 187/88, 86, 80, 73, 187/28, 1 R, 92, 93, 83, 90, 14; 188/188, 189, 41, 35, 36, 63; 24/115 L, 136 A, 136 R, 244 R

[56] References Cited

U.S. PATENT DOCUMENTS

| | | | |
|---|---|---|---|
| 1,139,595 | 5/1915 | Starr | 24/136 A |
| 1,798,777 | 3/1931 | Anderson | 24/136 R |
| 3,706,361 | 12/1972 | Paulssen et al. | 188/189 |
| 3,762,512 | 10/1973 | McIntyre | 188/189 |
| 4,141,117 | 2/1979 | Gompel | 24/136 R |

*Primary Examiner*—Robert J. Spar
*Assistant Examiner*—Kenneth Noland
*Attorney, Agent, or Firm*—Robert E. Greenstien

[57] ABSTRACT

An elevator car blocking apparatus is disclosed. A small, portable blocking apparatus is initially strapped to the elevator guide rail. It includes a roller and a retainer on which the car rests when it is blocked. The roller is forced between the rail and a retainer to block the car. The roller position between the rail and the retainer can be adjusted to allow the apparatus to be shifted easily on the rail.

3 Claims, 2 Drawing Figures

CAR BLOCKING APPARATUS

DESCRIPTION

Technical Field

This invention relates to apparatus for servicing and installing elevator systems; in particular, car blocking apparatus.

Background Art

During fabrication of an elevator system the cab is assembled in the shaftway and the cables or hydraulic equipment are then attached to the cab. This requires blocking the car in place in the shaft. Similarly, blocking is required to replace and repair the cables and hydraulic equipment.

Elevator cars are presently blocked by using timbers. These timbers are positioned between the bottom of the car and the shaft pit to "prop" the car in place. These timbers are large and expensive, and they are rather difficult to move around. This particular type of blocking arrangement does not allow the car to be blocked between floors.

Disclosure of Invention

An object of the present invention is to provide apparatus for car blocking between floors without using timbers.

According to the present invention the weight of the car is applied to an apparatus which is removably attached to the rail. The apparatus includes a wedge which, under the weight of the car, is driven between a retainer and the elevator guide rail. The apparatus is initially attached to the rail at a selected position along its length and the wedge is then moved into position between the retainer and the rail. The car is then lowered onto the apparatus. The car's weight drives the wedge between the rail and the retainer.

A feature of the invention is that it provides a small, compact, positive blocking apparatus which can be used to support the car at any position in the shaft. Other objects, benefits and features will be apparent to one skilled in the art from the following description of an exemplary embodiment thereof, as illustrated in the accompanying drawings.

BEST MODE FOR CARRYING OUT THE INVENTION

Figure 1:
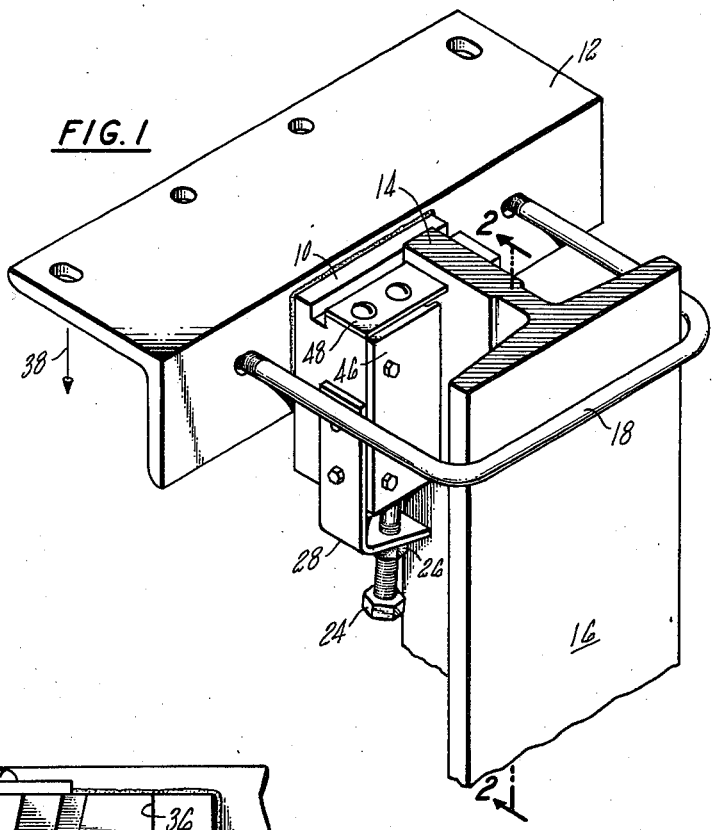
FIG. 1 is a perspective view which shows a car blocking apparatus according to the present invention attached to an elevator guide rail.

Referring to FIG. 1, car blocking apparatus according to the present invention includes a retainer 10 which includes an attached (e.g. by welding) L bracket 12 on which the car (not shown) rests. The car riding surface 14 (on which the car guide roller's roll) of a guide rail 16 is positioned within a slot 17 in the retainer 10. The apparatus is initially strapped to the rail by means of a U-bolt 18 which is passed around the rail and tightened onto the L bracket 12.

Figure 2:
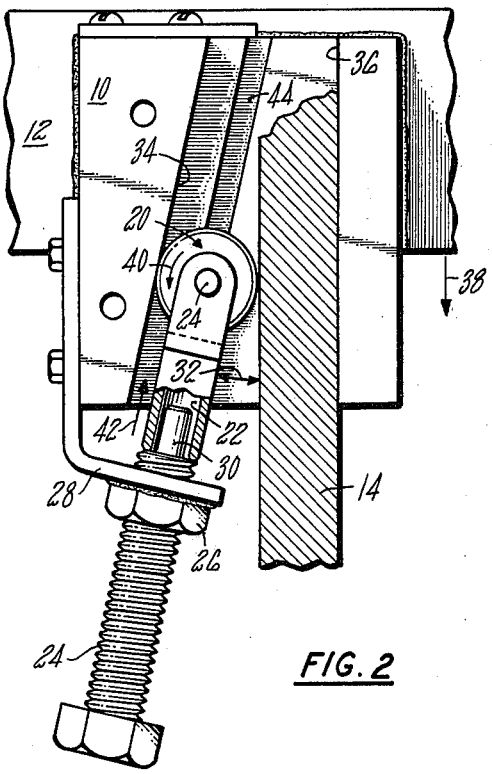
FIG. 2 is a cross-sectional view, along the line 2—2 in FIG. 1, of the car blocking apparatus.

Referring to FIG. 2, within the retainer slot 17 there is a roller 20 which rotates on a pin 24 which is attached to a yoke 22. A threaded bolt 24 passes through a corresponding nut 26 which is welded to bracket 28 which is attached (at angle) to the retainer 10. The yoke 22 rotates about a stud 30 which is attached (e.g. by welding) to the bolt 24. The bolt axis is at an angle 32 to the rail 14. The bolt 24 is rotated to move the roller in the direction 42 which forces it between the rail 14, the retainer wall 34. This, in turn, forces the rail against the flat retainer wall 36. Car movement in direction 35 causes the roller to rotate in a direction 40, which causes the roller to be increasingly wedged between the guide rail 14 and the wall 34. This increases the pressure applied between the retainer and the rail.

The outer edge of the roller may be roughened (e.g. treaded) in order to increase the traction and the wedging action. The stud 30 acts to maintain proper alignment of the roller while allowing it to move along the bolt positioning axis (in the direction 42) so that it can be further forced between the retainer and the rail.

The retainer 10 may be slotted 44 to receive an axially extended portion of the pin 24. Similarly, the removable retainer cover plate 46 (See FIG. 1) may be "mirror" slotted on its inner surface to receive the opposite end of the pin. These slots act to support the roller between the rail and the surface 34 in a direction normal to the position axis (direction 42). A removable plate 48 attached to the upper surface of the retainer establishes a slot with the retainer wall 36 in order to provide initial alignment of the rail and retainer when the apparatus is initially positioned on the rail through the use of the U-bolt 18.

The apparatus can be positioned anywhere along the rail length. Thus, the car can be blocked at any position in the shaft. The foregoing, of course, may suggest to one skilled in the art other modifications and variations to the exemplary embodiment that has been described without departing from the true scope and spirit of the invention embodied therein.

I claim:

1. An apparatus for blocking an elevator car in position in a shaftway containing an elevator guide rail, characterized by:

a retainer member containing a slot for receiving a portion of the guide rail and adapted for supporting the car, a wedge member which is adapted to be driven, within said slot, between the retainer and the guide rail in response to car movement, said wedge member being carried on the retainer and being adapted to be adjustably positioned between the retainer and the rail, clamping means for attaching the retainer to said rail, said wedge member being attached to a bolt that is carried on the retainer and rotatable for controlling the position of the wedge within said retainer along the positioning axis of said bolt, and said wedge member comprising a roller, a yoke, a first pin and a second pin, said roller being mounted on said first pin to rotate thereon, said first pin being mounted to said yoke, said yoke being mounted on said second pin to rotate around the axis of said second pin, said second pin being attached to said bolt with said axis oriented to permit said yoke to rotate around the positioning axis of said bolt.

2. An apparatus according to claim 1, characterized by:

said retainer containing, for providing support for said roller, a second slot, which receives one end of said first pin on which said roller is mounted, and a removable cover containing a third slot for receiving the opposite end of said first pin when said cover is attached to the retainer.

3. An apparatus for blocking an elevator car in position in a shaftway containing an elevator guide rail, characterized by:

a retainer member containing a slot for receiving a portion of the guide rail and adapted for supporting the car, an adjustable wedge member which is driven between the retainer and the guide rail, said wedge member being carried on the retainer and being adapted to be adjustably positioned between the retainer and the rail, clamping means for attaching the retainer to said rail, said wedge member including a roller, said wedge member being attached to a bolt carried on the retainer, said bolt rotatable for controlling the position of the wedge within said retainer, said wedge member being movable along the position axis on said bolt, said means for attaching said retainer to said rail comprises a U-bolt adapted to be positioned around the rail with its bifurcated ends extending through the retainer, said roller being rotatable on a pin attached to a yoke which is rotatably positioned about an alignment pin attached to said bolt, and said retainer containing a second slot, which receives one end of said pin, and a removable cover containing a slot for receiving the opposite end of the pin, said slots providing support for said roller movement to said position axis.

* * * * *